United States Patent [19]

Fritzsche et al.

[11] 3,994,637

[45] Nov. 30, 1976

[54] ROTARY PISTON ENGINE OF TROCHOIDAL DESIGN

[75] Inventors: Albert Fritzsche, Markdorf; Jürgen Lambrecht, Irschenhausen, both of Germany

[73] Assignee: Dornier System GmbH, Germany

[22] Filed: July 24, 1975

[21] Appl. No.: 598,737

[30] Foreign Application Priority Data

Aug. 16, 1974 Germany ..... 2439265

[52] U.S. Cl. ..... 418/61 B; 418/125

[51] Int. Cl.[2] ..... F01C 1/02; F04C 17/02; F01C 19/04

[58] Field of Search ..... 418/61 B, 125, 129

[56] References Cited

UNITED STATES PATENTS

| | | | |
|---|---|---|---|
| 3,226,013 | 12/1965 | Toyoda et al. | 418/61 B |
| 3,764,239 | 10/1973 | Huf | 418/125 |
| 3,885,897 | 5/1975 | Huf | 418/129 |
| 3,923,430 | 12/1975 | Huf | 418/61 B |

*Primary Examiner*—John J. Vrablik
*Attorney, Agent, or Firm*—James E. Bryan

[57] ABSTRACT

This invention relates to an improvement in a rotary piston engine of trochoidal design, of the epitrochoidal or hypotrochoidal type with an outer envelope, with the piston surface and/or housing bore being equidistant to the mathematically exact trochoid, and including a follow-up drive, the improvement comprising that the minus-equidistant of the piston and/or of the housing bore has a value exceeding 10% of that of the generating radius and smaller that that for which the piston contour is tangent with the follow-up drive in the dead center positions.

1 Claim, 5 Drawing Figures

ROTARY PISTON ENGINE OF TROCHOIDAL DESIGN

The present invention relates to a rotary piston engine of trochoidal design, of the epi- or hypotrochoidal type with an outer envelope, with the piston surface and/or housing bore being equidistant to the mathematically exact trochoid and with a synchronization gear or drive unit also being provided for piston follow-up.

German Auslegeschrift No. 2,059,965 discloses a rotary piston engine of trochoidal design based on the problem of achieving optimum compression and sealing by means of extensive reduction of the gap between the piston and the housing contour, the contours of the housing and the piston having the shapes of parallel curves to the trochoid and its envelope. These parallel curves fall outside the precise geometric curve and are denoted as plus-equidistants; parallel curves falling inside the precise geometric curve also are termed minus-equidistants. In order to utilize radial sealing strips of slight thickness and slight radius of the top circle, the ratio of equidistant $a$ to generating radius R is maintained in the order of magnitude of 2%, in known manner.

Further a rotary piston engine (U.S. Pat. No. 3,474,954) is known, wherein the housing in the region of the operational chambers consists of arcs of a circle and where the transition region between said chambers also is designed as arcs of a circle. Both radii are related in definite mathematical relationships, so that only one may be freely selected. No equidistants are present.

Regarding an epitrochoid with a ratio of cycloidal-path radius to base-circle radius of 1 and with an outer envelope, eccentricity E, which is equal to the radius of the crankshaft, is so selected that one obtains a trochoid without a point of inflection. This will be the case for a ratio of $E/R \leq 0.25$. If in such a design equidistant $a$ of the piston and the housing is equal to zero, then an engine design with a high theoretical compression ratio $\epsilon_{th}$ necessarily entails lesser eccentricity, that is, a lesser crankshaft radius Therefore, a single-disc design with overhung piston support and the single and multi-disc design with bilateral support and two-stage geared follow-up drive for maximum operating pressure are limited with respect to piston width and/or in the number of pistons per eccentric shaft and follow-up, because the maximum torque is approximately proportional to the square of the eccentricity.

The invention addresses the problem of providing a rotary piston engine of the type initially described, the radius of curvature of the radial seal and preferably the radius of the crankshaft, and hence the loading capacity of the follow-up drive unit, being increased without changing the piston size.

The problem is solved by the invention for the case of a trochoidal engine with external envelope in that the negative equidistants of the pistons and of the inside contour of the housing are of a value exceeding 10 % of that of the generating radius, but smaller than that at which the piston contour is tangent with the follow-up gear unit when in the dead-center positions.

Independently of generating radius R and eccentricity E, the equidistant $a$ is included as a parameter in the design of the chamber shape, the trochoidal engine with outer envelope thereby, if desired, being designed for follow-up kinematics for higher loads.

Further advantages, characteristics and applications of the invention will be further illustrated in the accompanying drawings, in which.

Figure 1:
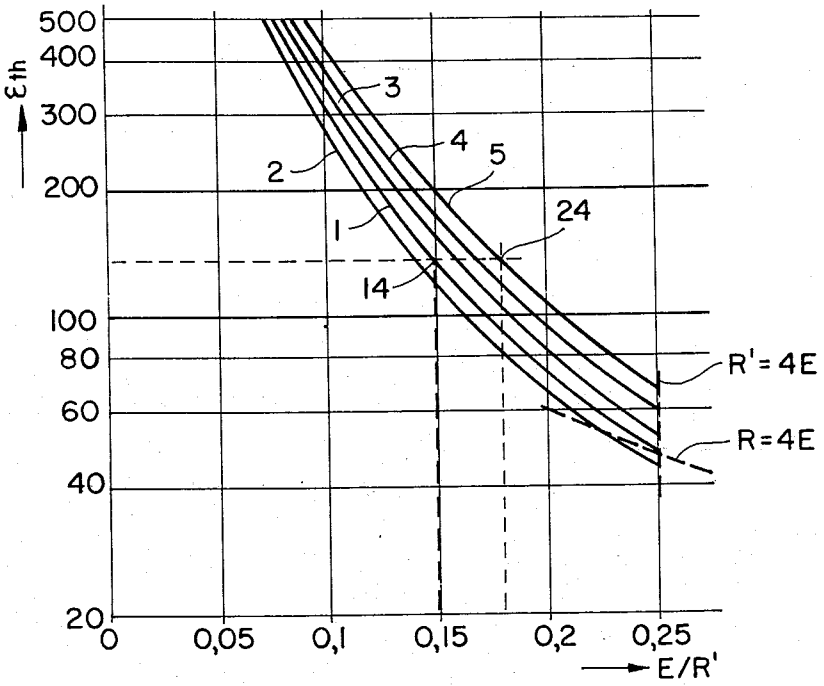
FIG. 1 is a diagram showing the mathematical basis of the invention.
Figure 5:
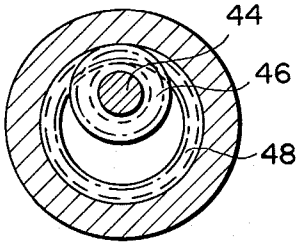
FIG. 5 is a sectional view taken on line 5–5 of FIG. 4 and looking in the direction of the arrows.

FIG. 1 shows in diagrammatic form the dependence of the theoretical compression ratio $\epsilon_{th}$ on the ratio of the eccentricity $E$to the actual piston radius $R' = R - a$, where $\epsilon_{th}$ is plotted as the ordinate and $E/R'$ as the abscissa. The curves were computed for an epitrochoid with outer envelope, the ratio of base-circle radius to cycloidal path radius being equal to 1. The curves are denoted by numbers 1 through 5, curve 1 showing the mathematically exact trochoid, for which the ratio of equidistant to generating radius $R$ of the epitrochoid is equal to zero. Curve 2 shows a plus-equidistant for the piston, the ratio $a/R$ being equal to 0.1. Curves 3, 4 and 5 are for minus-equidistants of the piston, the $a/R$ values being shown between −0.1 (curve 3); −0.2 (curve 4), and −0.3 (curve 5).

The curves are limited on the right-hand side of the graph by a vertical line $R' = 4E$ forming the flat-point limit for epitrochoids with a ratio of base-circle to cycloidal path of 1. Curve $R = 4E$ is a further limit, denoted as a gearing limit, upon exceeding which the generating radius cuts into the gearing of the follow-up drive when a gear with inside teeth is provided as a follow-up drive.

Figure 2:
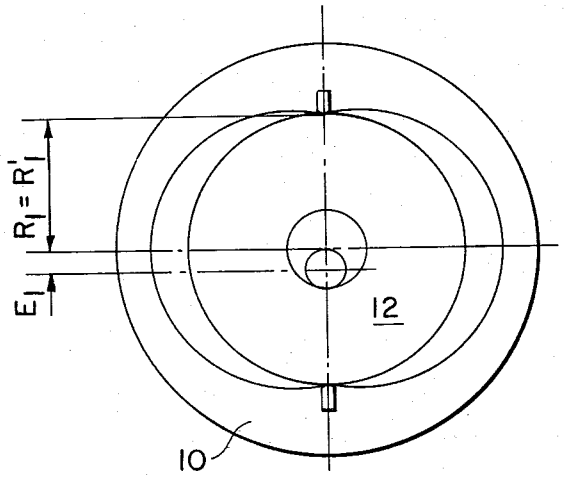
FIG. 2 is a rotary piston of trochoidal design with a housing bore and a piston contour conforming precisely to the mathematical trochoid.
Figure 3:
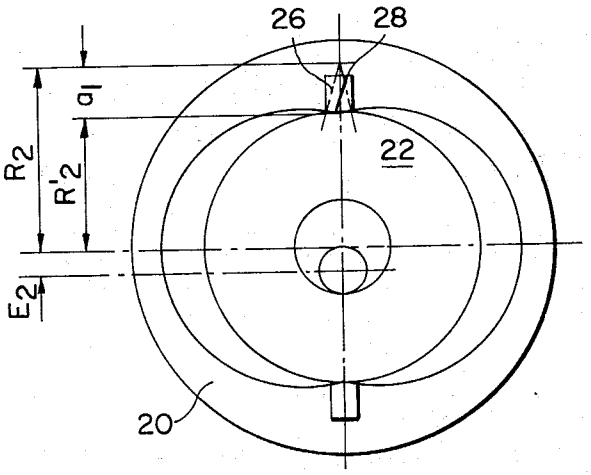
FIG. 3 is a rotary piston engine of trochoidal design.

The essence of the invention is made clearer by contrasting FIG. 2 and FIG. 3. Both figures each show a housing 10 and 20, furthermore each a piston, 12 and 22, mounted in each housing. FIG. 2 shows a rotary piston engine of trochoidal design at operating point 14 of curve 1, and both FIGS. 2 and 3 show a rotary piston engine of the invention at operating point 24 of curve 5. These operating points correspond to the same value of the theoretical compression ratio $\epsilon_{th}$.

Operating point 14 on axis $E/R'$ has a value of 0.148, whereas operating point 24 has a computed value of 0.179.

The design of the rotary piston engine of trochoidal form in FIGS. 2 and 3 clearly reveals that eccentricity $E$ for the operating point 14 in FIG. 2 is significantly less than that of operating point 24 of FIG. 3. This shows that as the minus-equidistant increases, larger eccentricity results and therefore, within the limits of geometry, the follow-up unit cross-section will also increase. Comparison of FIGS. 2 and 3 simultaneously shows that the design of the invention of FIG. 3 provides the following advantages regarding the sealing of the piston 22 with respect to the housing 20:

- radial sealing strip 26 is of a larger top-circle radius 28, improving the gap effect between the radial sealing strip and the piston; sealing strip 26 for a given compression is of lesser surface pressure;
- the wear of the sealing strip is reduced;
- when dealing with liquids and moderate pressure differences, the geometric shape will suffice as a contact-less seal;

the short stroke nature is improved in the engine of the invention with respect to previous designs.

Selecting the equidistants as a third parameter independent of the generating radius $R$ and the eccentricity $E$, shown in curves 2, 3, 4, and 5, and in FIG. 3, provides the advantage that the eccentricity, and hence the crankshaft radius, may be freely chosen within a wide range, so that optimum design of the follow-up unit is made possible. The latter for an overhung piston bearing, or for bilateral support, also for a two-stage gear follow-up drive may be designed that maximum torque may be transmitted and, furthermore, that several pistons may act on one follow-up drive.

FIG. 1 furthermore shows that for equal eccentricities (3, 4, 5), the compression ratio will increase.

The following mathematical relationships apply in FIGS. 2 and 3:

$$\epsilon_1 \cong \epsilon_2$$

$$R_1 = R_2$$

$$E_2 = 0.179\ R_2'$$

$$E_1 = 0.148\ R_1'$$

$$V_2/V_1 = E_2/E_1 = 1.21$$

Figure 4:
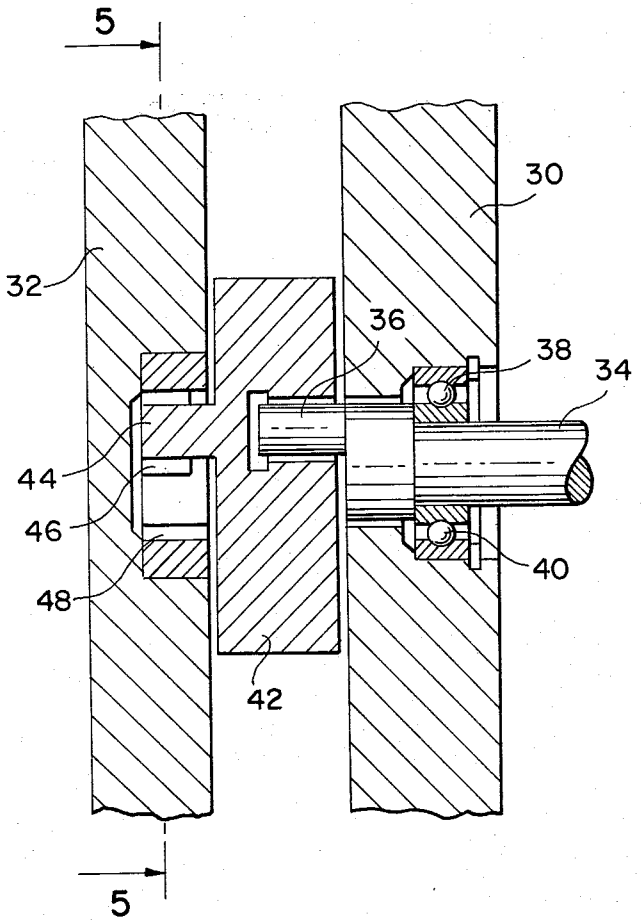
FIG. 4 is a sectional view through a trochoidal engine of known construction.

Referring to FIG. 4, there is shown a section through a trochoidal engine of known design having the housing walls 30 and 32. A drive shaft 34 having a throw 36 thereon is journaled in the bearings 38 and 40. The drive shaft throw 36 extends into the piston 42, which piston has an extension 44 on the left-hand side thereof and has a gear wheel 46 mounted thereon by means of a press fit, a key, or other known securing means. The teeth of the gear wheel 46 mesh with the teeth 48 of an interior gear in the housing wall 32 thereby effecting the follow-up drive of the piston 42 as the piston rotates.

It will be obvious to those skilled in the art that many modifications may be made within the scope of the present invention without departing from the spirit thereof, and the invention includes all such modifications.

What is claimed is:

1. In a rotary piston engine of trochoidal design, of the epitrochoidal or hypotrochoidal type with an outer envelope, with the piston surface and/or housing bore being equidistant to the mathematically exact trochoid, and including a follow-up drive, the improvement comprising that the minus-equidistant of the piston and/or the housing bore has a value exceeding 10% of that of the generating radius and smaller than that for which the piston contour is tangent with the follow-up drive in the dead center positions.

* * * * *